US006186089B1

(12) United States Patent
Le Tiec et al.

(10) Patent No.: US 6,186,089 B1
(45) Date of Patent: Feb. 13, 2001

(54) APPARATUS FOR ENAMELLING A CONDUCTIVE WIRE

(75) Inventors: Pierre-Yves Le Tiec, Tergnier; Raymond Andre; Michel Debray, both of Autreville, all of (FR)

(73) Assignee: Alcatel, Paris (FR)

( * ) Notice: Under 35 U.S.C. 154(b), the term of this patent shall be extended for 0 days.

(21) Appl. No.: 09/070,869

(22) Filed: May 1, 1998

(30) Foreign Application Priority Data

May 2, 1997 (FR) ..... 97-05444

(51) Int. Cl.[7] ..... B05C 13/02
(52) U.S. Cl. ..... 118/67; 118/712
(58) Field of Search ..... 432/8, 72, 47, 432/37; 34/630, 79, 640; 118/68, 707, 67, 65, DIG. 18, DIG. 19, 712

(56) References Cited

U.S. PATENT DOCUMENTS 2,517,024 * 8/1950 Prescott et al. .
5,291,670 * 3/1994 Surra et al. .

FOREIGN PATENT DOCUMENTS 39 42 609 A1 6/1990 (DE) .
1 276 775 10/1961 (FR) .
64-11671 * 1/1989 (JP) .

OTHER PUBLICATIONS

Patent Abstracts of Japan, vol. 013, No. 182 (C–591), Apr. 27, 1989 corresponding to JP 01 11671 A (Furukawa Electric Co., Ltd.) Jan. 17, 1989.

* cited by examiner

*Primary Examiner*—Brenda A. Lamb
(74) *Attorney, Agent, or Firm*—Sughrue, Mion, Zinn, Macpeak & Seas, PLLC

(57) ABSTRACT

The enamelling apparatus includes at least one assembly constituted by an applicator for applying varnish on a conductive wire and an associated enamelling oven, with the wire passing through both of them. The enamelling oven has a single chamber filled internally with radiant heater elements facing the path of the wire and the atmosphere inside the chamber is controlled to have an oxygen content that is low, and less than 6% . The apparatus is suitable for use in the production of an enamelled wire.

15 Claims, 1 Drawing Sheet

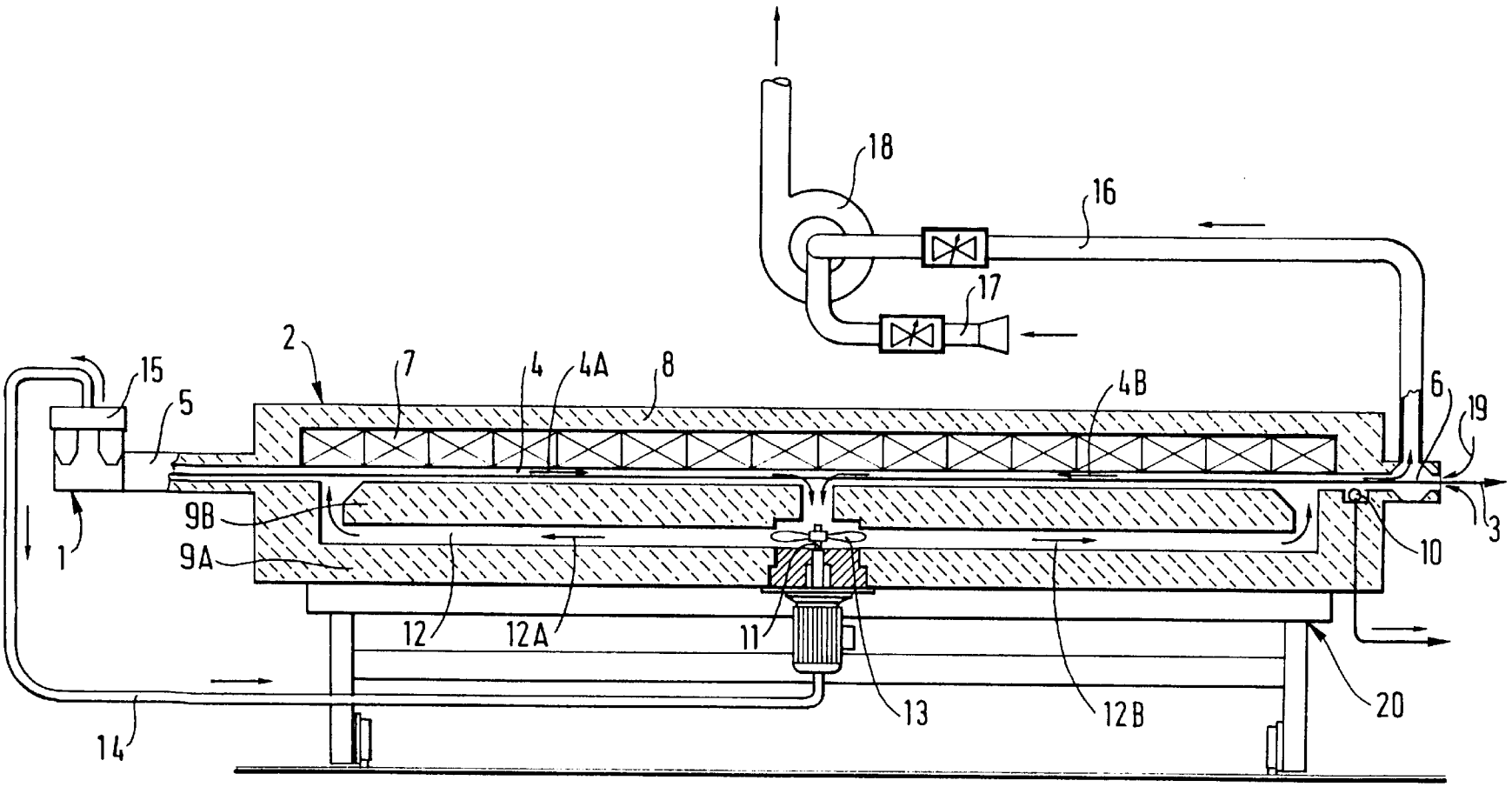
19
3
6
10
20
16
4B
12B
17
13
18
11
8
4A
4
12A
12
7
2
9B
9A
5
15
14
1

APPARATUS FOR ENAMELLING A CONDUCTIVE WIRE

The present invention relates to an apparatus for enamelling a conductive wire, the apparatus including an applicator for applying varnish on the wire and an enamelling oven, with the wire travelling through both of them.

BACKGROUND OF THE INVENTION

Document U.S. Pat. No. 5,291,670 disclosed an oven for enamelling conductive wires coated in a layer of resin (or varnish) dissolved in solvents. The oven includes a horizontal main chamber of elongate shape, an auxiliary assembly for sucking in and treating the solvent vapors coming form the main chamber, and a system for hot air convection therein.

The main chamber of the oven is subdivided into a zone for evaporating the solvents form the layer of resin on the wires, and a zone for polymerizing and cross-linking the resin. It is fitted with a horizontal row of electric resistance elements, which are mounted inside the chamber, and with heat exchangers which define two of the opposite longitudinal walls of said main chamber.

The auxiliary assembly has a suction mechanism for sucking in a flow of air and solvent vapor from the main chamber, between the two zones thereof. It also includes a heater mechanism for treating the sucked in flow. It is coupled to one of the ends of the heat exchangers to feed them with hot air provided by the treated flow.

The hot air convection system has a duct which couples the other ends of the heat exchangers to one of the ends of the main chamber. This ensures that the treated flow is recycled, with the flow being reinserted into the main chamber after it has travelled through the heat exchangers along the chamber.

In the main chamber of that enamelling oven, the solvent evaporation zone is maintained at a temperature in the range 150° C. to 350° C. while the resin polymerization and cross-linking zone is maintained in the range 400° C. to 550° C. The flow sucked in from main chamber is treated at a temperature of about 700° C. to 750° C. in the auxiliary assembly. Each of the tow zones in the main chamber is maintained at the desired temperature by the heat delivered form the internal electrical resistance elements, and also to a large extent by the heat exchangers and the convection system.

The enamelling oven makes maximum use of heat exchange between the treated flow fo air and solvents and the wires to be enamelled. Nevertheless, it is complex and bulky in structure.

Document JP-A-01 11671 discloses an assembly for baking a layer of resin (or varnish) on a metal wire, comprising two heating ovens which are mounted one after the other and through which there travels the wire, coated in its resin layer. The first heating oven is a circulating air oven. It ensures that most of the solvents in the layer of resin on the wire evaporate and it maintains resin cross-linking at an insufficient degree, with oxidation of the resin and of the wire remaining below a certain degree. The second heating oven causes the resin to be cross-linked at high temperature, of an the order of 500° C., and is provided with an internal atmosphere having low oxygen content, less than 5%, to hinder oxidation of the resin and of the wire. The enamelling assembly requires a unit for treating the solvent vapor coming from the first heating oven, if pollution problems are to be avoided.

SUMMARY OF THE INVENTION

An object of the present invention is to avoid the drawbacks of the above-mentioned known solution.

The invention provides an apparatus for enamelling a conductive wire, the apparatus including at least one assembly constituted by an applicator for applying varnish on the wire and an enamelling oven with said wire passing through both of the, the oven itself including at least one elongate chamber fitted with a wire inlet and a wire outlet at tow opposite ends and fitted internally with radiant heater elements facing the path followed by the wire between the inlet and the outlet to evaporate the solvents form the varnish on the wire and/or to bake the varnish on the wire, and secondly means for treating the solvent vapor coming form the varnish on the wire, wherein the enamelling furnace includes a single chamber whose internal atmosphere has oxygen content that is low, controlled, and less than 6%, thereby making it possible firstly to evaporate the solvents and bake the varnish on said wire, and secondly to constitute the means for treating said solvent vapor by combustion on contact with the radiant heater elements in the single chamber, without giving rise to any flame.

Advantageously, the apparatus may also present at least one of the following additional characteristics:

- the single chamber includes a probe for measuring the oxygen content of the internal atmosphere, and an air feed inlet servo-controlled to the measurement of the probe;
- the single chamber is at a pressure lower than the pressure of the outside atmosphere; and
- the radiant heater elements are selected to be capable of raising the single chamber to a temperature of not less than 1000° C.

BRIEF DESCRIPTION OF THE DRAWING

The characteristics and advantages of the present invention appear from the following description of a preferred embodiment shown in the sole accompanying FIGURE.

This sole FIGURE is a section view through the enamelling apparatus of the invention.

DETAILED DESCRIPTION OF THE PREFERRED EMBODIMENTS

The enamelling apparatus includes a varnish applicator 1 and an enamelling oven 2 mounted following the applicator and coupled thereto, with the conductive wire 3 travelling horizontally through both of them in the embodiment shown. Naturally, in a variant, the apparatus could be disposed vertically.

The varnish applicator contains varnish dissolved in solvents for depositing a layer of the varnish on the wire passing through the applicator.

The enamelling oven 2 has a single chamber 4 for evaporating the solvents from the layer of varnish on the wire, with the solvent vapors being treated and the varnish on the wire being baked at high temperature as the wire travels through the chamber. The chamber is elongate in shape and of uniform rectangular section along its entire length, and it is supported on a support bench 20.

The oven 2 has an inlet 5 and an outlet 6 at opposite ends for the wire passing through the chamber. It is fitted with radiant heater elements 7 mounted in the chamber 4 facing the path followed by the wire therethrough. As shown, these elements are carried by and line the inside fo the top longitudinal wall 8 of the chamber, however they could equally well be on the other longitudinal walls of the oven. They are electrical resistance elements advantageously selected to enable the chamber 4 to be raised to a temperature of the order of 1000° C., or greater. Such electrical resistance elements are known per se, being of the type already in use, in particular in the automotive industry for baking paint.

One of the other longitudinal walls of the oven, in this case its bottom wall, is preferably constituted by a double wall referenced 9A and 9B.

The atmosphere inside the chamber 4 has a very low oxygen content, less than 6%, and preferably of the order of about 3%, which content is controlled, the chamber 4 is fitted with a probe 10 for measuring the oxygen content of its internal atmosphere. A controlled air inlet 11 is servo-controlled to the measurement probe and serves to maintain the oxygen content in the chamber at its desired low value.

The measurement probe 10 is mounted close to the path of the wire. 3. The controlled air inlet 11 is preferably at a distance therefrom. It opens out into a feed duct 12 extending along the chamber and opening out at both ends into opposite terminal inlet and outlet portions of the chamber. The controlled air inlet 11 takes place through the bottom wall of the oven, in particular into the central portion thereof or between the central portion and the inlet terminal portion, or even in the vicinity of the inlet portion. The feed duct 12 is advantageously defined between the two walls 9A and 9B of the bottom double wall of the oven. The measurement probe 10 is mounted at the outlet terminal portion of the chamber 4.

A fan 13 is mounted at the controlled air inlet 11 in the feed duct 12 to circulate the air inserted via the inlet in both directions towards the ends of the chamber 4 and within the chamber, as illustrated by oppositely-directed arrows 12A and 12B and by oppositely-directed arrows 4A and 4B. It mixes the flow of inserted air with the flow of air and vapor present in the chamber 4.

The measurement signal from the probe regulates the flow rate of the air which is inserted into the duct 12 and thus into the chamber 4 so that the oxygen content inside the chamber 4 is low while remaining sufficient to ensure complete and flameless combustion of the solvnet vapor in the chamber.

The chamber 4 is maintained at slightly less than atmospheric pressure and is made leakproof to avoid uncontrolled ingress of air other than via the controlled inlet 11. Its inlet 5 is directly coupled in hermetically sealed manner to the varnish applicator 1, which applicator is fitted with a suction hood 15. The outlet 6 from the chamber is connected to a suction duct 16. One of the ends of the duct 16 opens out into the periphery of the outlet 6 while its other end is coupled with an air feed duct 17 to a fan 18 enabling the suction flow rate to be adjusted. The outlet 6 is also fitted externally with a terminal nozzle for allowing outside air to enter at low pressure, as illustrated by arrows 19, which air is sucked into the suction duct 16 and also provides the required sealing of the outlet 6 around the wire and extraction of the combustion gases.

The suction hood 15 is fitted with a chimney for removing the air and solvent vapor sucked in from the applicator. Advantageously, this suction hood is coupled via an evacuation duct 14 to the controlled air inlet 11 so that the air sucked in in this way is then purified directly in the chamber 4. The suction hood 14 is controlled by the measurement probe which controls the flow sucked in by the hood and injected via the inlet 11 into the duct 12 and the chamber 4.

When the wire coated in its layer of varnish travels through the chamber 4, the solvents evaporate form the layer of varnish and the varnish is baked so as to be polymerized and cross-linked. The solvent vapor is immediately burnt completely on contact with the radiant heater elements 7, but without any flame because the oxygen content is low in the atmosphere inside the chamber 4, although sufficient to burn the varnish, In the terminal portion of the chamber 4 situated adjacent to the outlet 6, the atmosphere that is sucked out is totally free or nearly totally free for solvent vapor since that is consumed directly in the chamber 4.

Treatment of the solvent vapor is thus performed directly in the chamber 4 for baking the varnish on the wire, thus avoiding any problem of external pollution and the need for any equipment specifically for treating the vapor.

Advantageously, the temperature in the chamber is maintained at 1000° C. or even higher. It may be uniform along the length of the chamber 4. In a variant, a temperature gradient is created along the chamber, rising form the inlet 5 towards the outlet 6, or preferably rising from the inlet to a middle portion or a portion close to the outlet and then decreasing from the portion to the outlet.

The advantages of an enamelling oven or apparatus of the invention stem directly form its single-chamber design serving both for treating solvent vapor from the varnish on the wire, and for baking the varnish.

In addition, operating the chamber 4 at a very high temperature, much higher than the temperatures of the known solutions, makes it possible to increase production speed considerably for a given length of oven. Production speed is at least doubled for a chamber 4 operating at 1000° C.

Naturally, it is possible to adopt variants compared with the embodiment shown and described above without thereby going beyond the ambit of the invention. Thus, in particular, the radiant heater elements may face the path followed by the wire coated in the layer of varnish without necessarily being carried by the top wall of the oven. Similarly, the controlled air feed to the chamber can be performed in a manner other than that shown, without the feed duct being integrated in one or another of the walls of the oven.

It should also be observed that the enamelling apparatus may have a plurality of assemblies analogous to the assembly constituted by the applicator 1 and the associated oven 2, with such assemblies then being connected one after another.

Also, it is specified that the oven is designed to be suitable for opening lengthwise and to be retracted away form the path followed by the wore so as to enable the apparatus to be started while the wire is outside the oven until it has reached a speed that is sufficient to avoid the wire melting if the chamber is at about 1000° C. The oven is then brought back into place in the apparatus and is closed on the wire, once the speed of the wire is sufficient to avoid this problem.

What is claimed is:

1. An apparatus for enamelling a conductive wire, the apparatus comprising:

at least one enamelling assembly including:

an applicator for applying varnish on the wire, and an enamelling oven, said wire passing through both said applicator and said oven, said oven comprising:

a single elongate chamber fitted with a wire inlet and a wire outlet at two opposite ends of said single chamber, and fitted internally with radiant heater elements facing a path followed by the wire between said wire inlet and said outlet within said single chamber to evaporate solvents from the varnish on the wire and to bake the varnish on the wire within said single chamber, and means for treating solvent vapor evaporated directly within said single chamber, said treatment means comprising said radiant heater elements and control means for controlling an internal atmosphere in said single chamber at an oxygen content that is less than 6% while remaining sufficient to burn solvent vapor arising form the varnish on the wire by combustion on contact with said radiant heater elements within said single chamber, without giving rise to any flame.

2. The enamelling apparatus according to claim 1, wherein said control means comprises a probe for measuring the oxygen content of said internal atmosphere, and an air feed inlet servo-controlled to the measurement of said probe.

3. The enamelling apparatus according to claim 1, wherein said radiant heater elements are mounted along a first wall of said oven.

4. The enamelling apparatus according to claim 3, wherein said radiant heater elements line an inside of said first wall of said oven.

5. The enamelling apparatus according to claim 3, wherein said air feed inlet is provided through a second wall of the oven.

6. The enamelling apparatus according to claim 5, wherein said second wall is a double wall including an air feed duct defined between the tow walls of said double wall and opening out into two opposite terminal portions of said single chamber, and wherein said feed inlet is made through an outermost wall of said double wall.

7. The enamelling apparatus according to claim 6, including a fan mounted in said feed duct facing said air feed inlet.

8. The enamelling apparatus according to claim 1, wherein said radiant heater elements raise said single chamber to a temperature of not less than 1000° C.

9. The enamelling apparatus according to claim 8, wherein said radiant heater elements are selected to create a temperature gradient along said single chamber.

10. The enamelling apparatus according to claim 9, wherein said single chamber has a temperature gradient rising from said wire inlet to a substantially middle portion of said single chamber and then falling from said middle portion to said wire outlet.

11. The enamelling apparatus according to claim 8, wherein said oven is openable lengthwise and retractable from the path followed by the wire through said oven.

12. An apparatus for enamelling a conductive wire, the apparatus comprising:

at least one enamelling assembly including:

an applicator for applying varnish on the wire, and an enamelling oven, said wire passing through both said applicator and said oven, said oven comprising:

a single elongate chamber fitted with a wire inlet and a wire outlet at tow opposite ends of said single chamber, and fitted internally, with radian theater elements facing a path followed by the wire between said wire inlet and said outlet within said single chamber, to evaporate solvents form the varnish on the wire and to bake the varnish on the wire within said single chamber, and means for treating solvent vapor evaporated from the varnish on the wire directly within said single chamber, said treatment means comprising said radiant heater elements and control means for controlling an internal atmosphere in said single chamber at an oxygen content that is less than 6% while remaining sufficient to burn solvent vapor arising from the varnish on the wire by combustion on contact with said radiant heater elements within said single chamber, without giving rise to any flame;

wherein said control means comprises a probe for measuring the oxygen content of said internal atmosphere, and an air feed inlet servo-controlled to the measurement of said probe; and wherein said single chamber is at a pressure lower than an atmospheric pressure.

13. The enamelling apparatus according to claim 12, wherein said wire inlet is hermetically connected to said applicator which is fitted with associated suction means, and wherein said wire outlet is connected to a suction duct having two ends, and one of its ends opens out to a periphery of said wire outlet and its other end is connected with an air feed duct to a fan.

14. The enamelling apparatus according to claim 13, wherein said suction means associated with said applicator is connected via an evacuation duct to said air feed inlet and is controlled by said measurement probe.

15. The enamelling apparatus line according to claim 13, wherein said wire outlet is fitted externally with terminal means enabling outside air to enter at a low pressure.

* * * * *